US005253503A

United States Patent [19]

Barten et al.

[11] Patent Number: 5,253,503

[45] Date of Patent: Oct. 19, 1993

[54] APPARATUS FOR COUNTERBALANCING AND VERTICAL BENDING OF THE WORK ROLLS OF A FOUR-HIGH ROLLING MILL STAND

[75] Inventors: Axel Barten, Siegen-Sohlbach; Werner Moritz, Siegen, both of Fed. Rep. of Germany

[73] Assignee: Achenbach Buschhütten GmbH, Kreuztal, Fed. Rep. of Germany

[21] Appl. No.: 808,769

[22] Filed: Dec. 17, 1991

[30] Foreign Application Priority Data

Dec. 21, 1990 [DE] Fed. Rep. of Germany ..... 4041290

[51] Int. Cl.[5] ..... B21B 29/00

[52] U.S. Cl. ..... 72/239; 72/241.8; 72/245

[58] Field of Search ..... 72/241.2, 241.4, 241.8, 72/245, 246, 239; 100/162 B, 170

[56] References Cited

U.S. PATENT DOCUMENTS 4,543,810 10/1985 Stoy et al. ..... 72/245
4,907,439 3/1990 Diel et al. ..... 72/245

FOREIGN PATENT DOCUMENTS 955132 12/1956 Fed. Rep. of Germany .
1289811 2/1969 Fed. Rep. of Germany .
1527642 4/1970 Fed. Rep. of Germany .
0073497 6/1970 Fed. Rep. of Germany ..... 72/245
1936769 2/1971 Fed. Rep. of Germany .
2804007 8/1979 Fed. Rep. of Germany ..... 72/245
3728795 3/1989 Fed. Rep. of Germany .
0181704 11/1982 Japan ..... 72/245
57-181705 11/1982 Japan .

*Primary Examiner*—Lowell A. Larson
*Assistant Examiner*—Thomas C. Schoeffler
*Attorney, Agent, or Firm*—Young & Thompson

[57] ABSTRACT

The apparatus for the counterbalancing and vertical bending of the work rolls of a four-high rolling mill stand (1) comprises respectively two dual-acting hydraulic adjusting cylinders (13) installed in the bottom work roll chocks (4) symmetrically to the roll axis plane (12—12). The adjusting piston (14) of the adjusting cylinders (13) serves for moving the piston rod (15) out of the bottom chock (4) and for moving the free end of the piston rod (15) into the top work roll chock (15) during rolling operation, and for moving the piston rod (15) into the bottom chock (4) for the separate dismounting of the work rolls (6, 7). During rolling operation, the extended piston rod (15) is connected, by means of a coupling device (16), with a shaft (22) supported in articulated fashion in the top chock (5).

4 Claims, 4 Drawing Sheets

Figure 1:
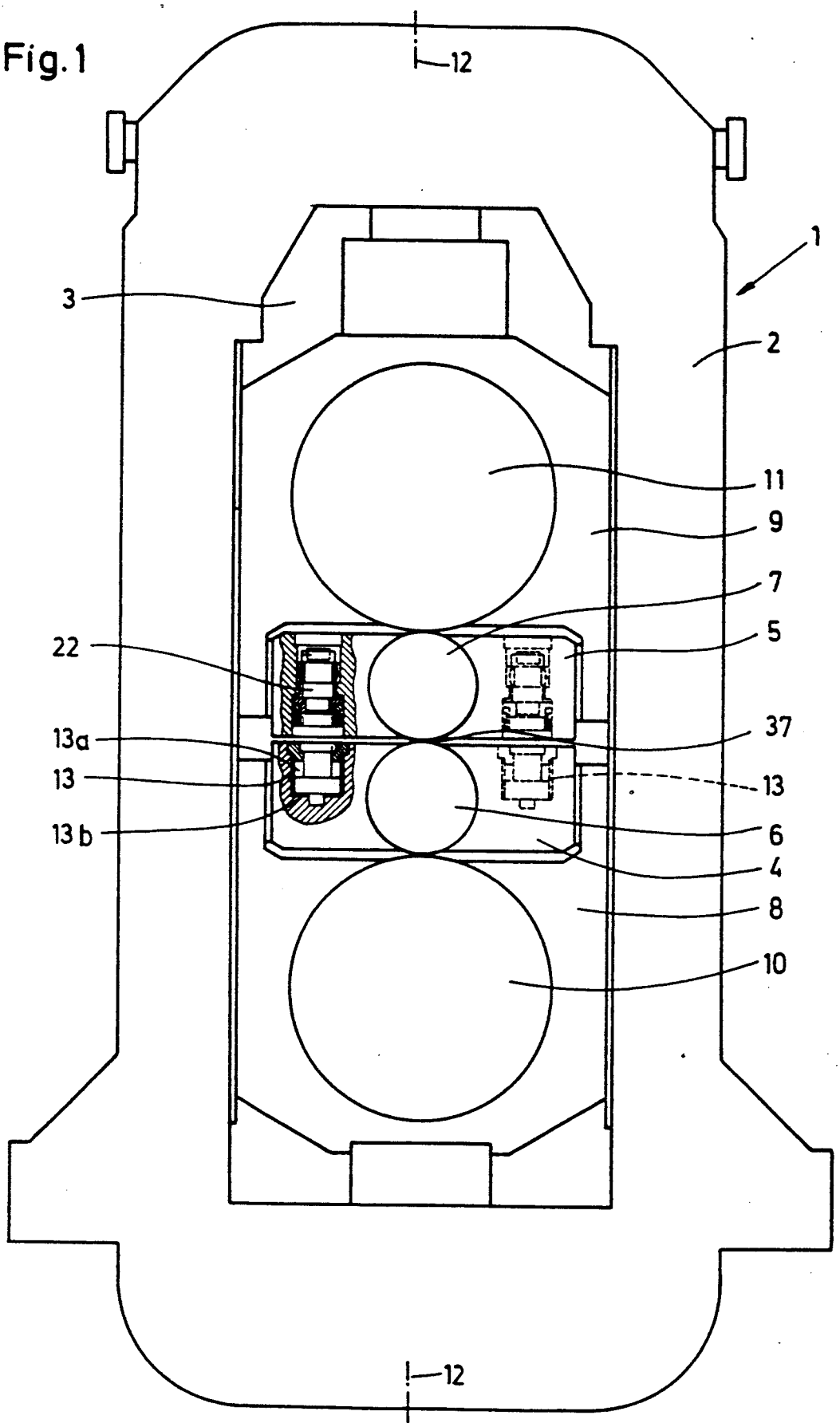

APPARATUS FOR COUNTERBALANCING AND VERTICAL BENDING OF THE WORK ROLLS OF A FOUR-HIGH ROLLING MILL STAND

The invention relates to an apparatus for the counterbalancing and vertical bending of the work rolls of a four-high rolling mill stand, with adjusting cylinders installed in the roll chocks and arranged symmetrically to the roll axis plane.

In such a counterbalancing and bending apparatus, known from German Patent 1,289;811, for the work rolls for controlling the thickness and flatness of the rolled strip, respectively two dual-acting adjusting cylinders are installed in the top and bottom backup roll chocks of the two roll housings of a rolling mill stand. An adjusting piston is arranged in each cylinder, engaging with an extension into a recess in a work roll chock. The adjusting piston is designed as a hollow piston with an internal chamber into which projects a guide piston, the latter being attached to a fixed piston rod. The inner chamber of the adjusting piston is divided by the guide piston into two pressure chambers in communication, via the piston rod and, respectively, the guide piston, with respectively one feed and one discharge conduit for a hydraulic oil. Upon the introduction of hydraulic oil into the mutually facing pressure chambers of the adjusting pistons of the opposed adjusting cylinders of the two adjusting cylinder pairs installed in the roll housings of a rolling mill stand, the adjusting pistons are moved toward each other so that the work rolls are subject to a concave deflection with respect to the roll nip. Upon the feeding of hydraulic oil into the mutually facing-away pressure chambers of the adjusting pistons of the opposed adjusting cylinders, the adjusting pistons are moved away from each other, and thereby a convex bending of the work rolls is achieved.

On account of the large bending forces acting on the extensions of the adjusting pistons upon transmission of the adjusting forces to the work roll chocks, the adjusting cylinders are exposed to high surface pressures between the outer jacket of the adjusting piston and the inner shell of the cylinder, as well as between the cylindrical surface of the guide piston and the wall of the inner chamber of the adjusting piston; these surface pressures can adversely affect the running properties of the adjusting pistons and can lead to disturbances in operation. Furthermore, the conventional counterbalancing and bending apparatus is relatively expensive due to the required installation of, in each case, four adjusting cylinders into the two housings of a four-high rolling mill stand.

The invention is based on the object of developing a counterbalancing and bending apparatus for the work rolls of a four-high rolling mill stand that is safe in operation and simplified as compared with the conventional apparatus.

The counterbalancing and bending apparatus is distinguished by the following advantages:

The exertion of the adjusting forces, needed for the vertical bending of the work rolls, on the lower and upper work roll chocks by means of respectively two hydraulic adjusting cylinders accommodated in the lower work roll chocks takes place in the direction of the cylinder axis so that the operating properties of the adjusting pistons in the cylinders are not impaired by any occurring surface contact pressures between the piston and the inner cylinder wall due to transverse forces. The releasable connection between the piston rod of the adjusting piston, pertaining to the adjusting cylinders installed in the bottom work roll chocks, and the upper work roll chocks by means of a coupling to be operated by a hydraulic adjusting cylinder makes it possible to effect separate disassembly of the work rolls. Finally, the balancing and bending apparatus, having four adjusting cylinders per rolling mill stand, is of a substantially simpler structure than the known apparatus according to German Patent 1,289,811 which requires eight adjusting cylinders per rolling mill stand.

Figure 2:
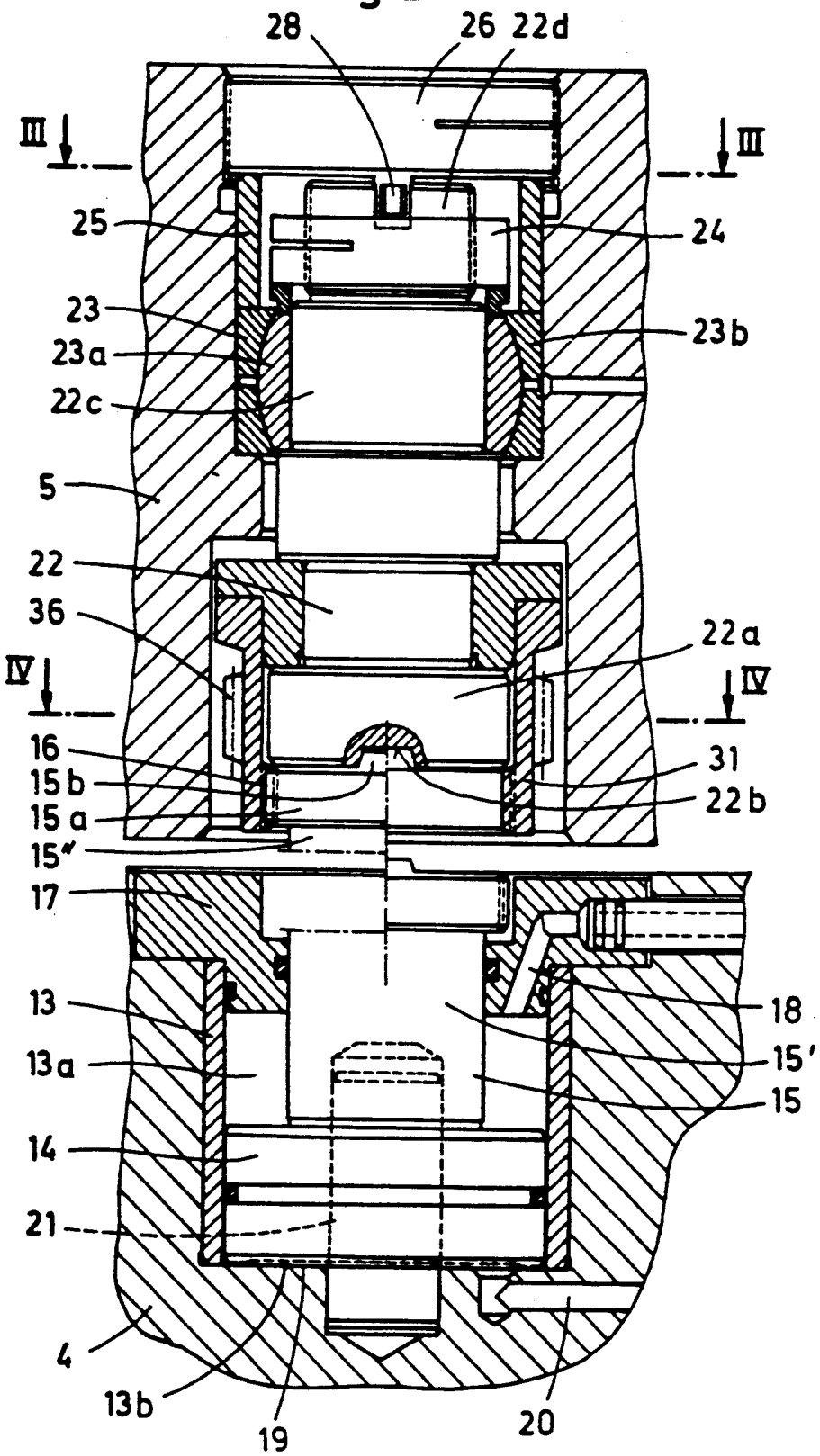
Figure 3:
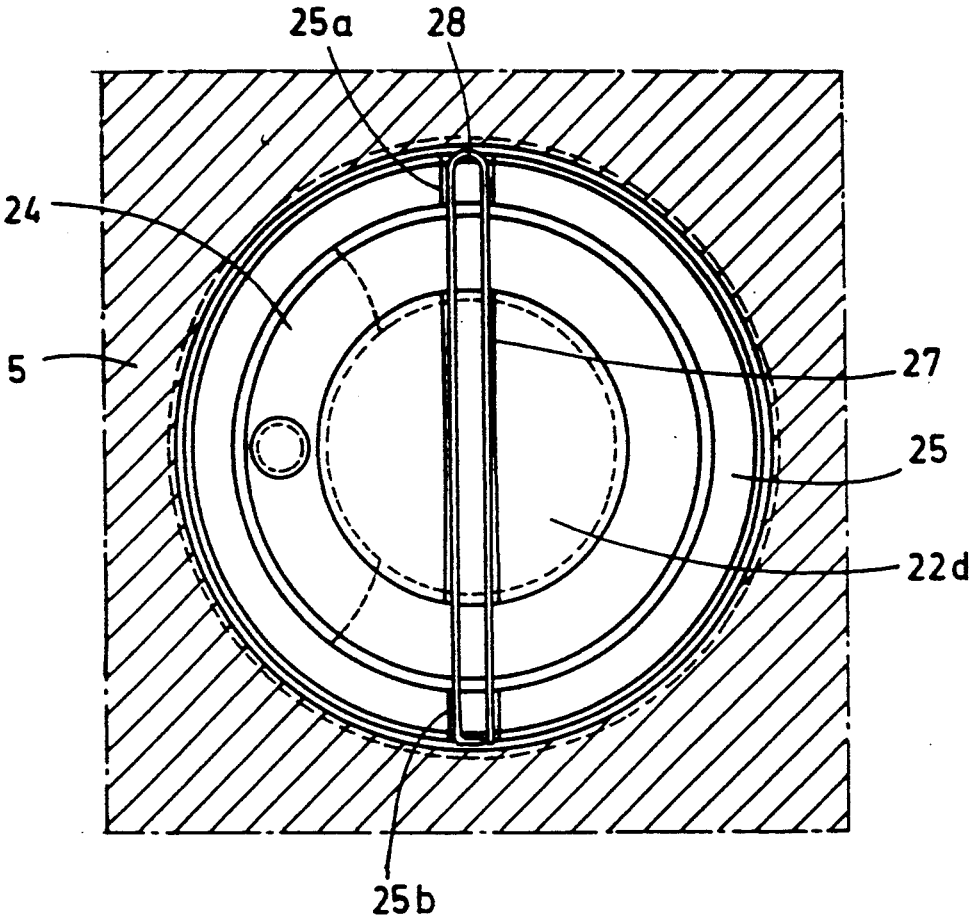
Figures 4, 5:
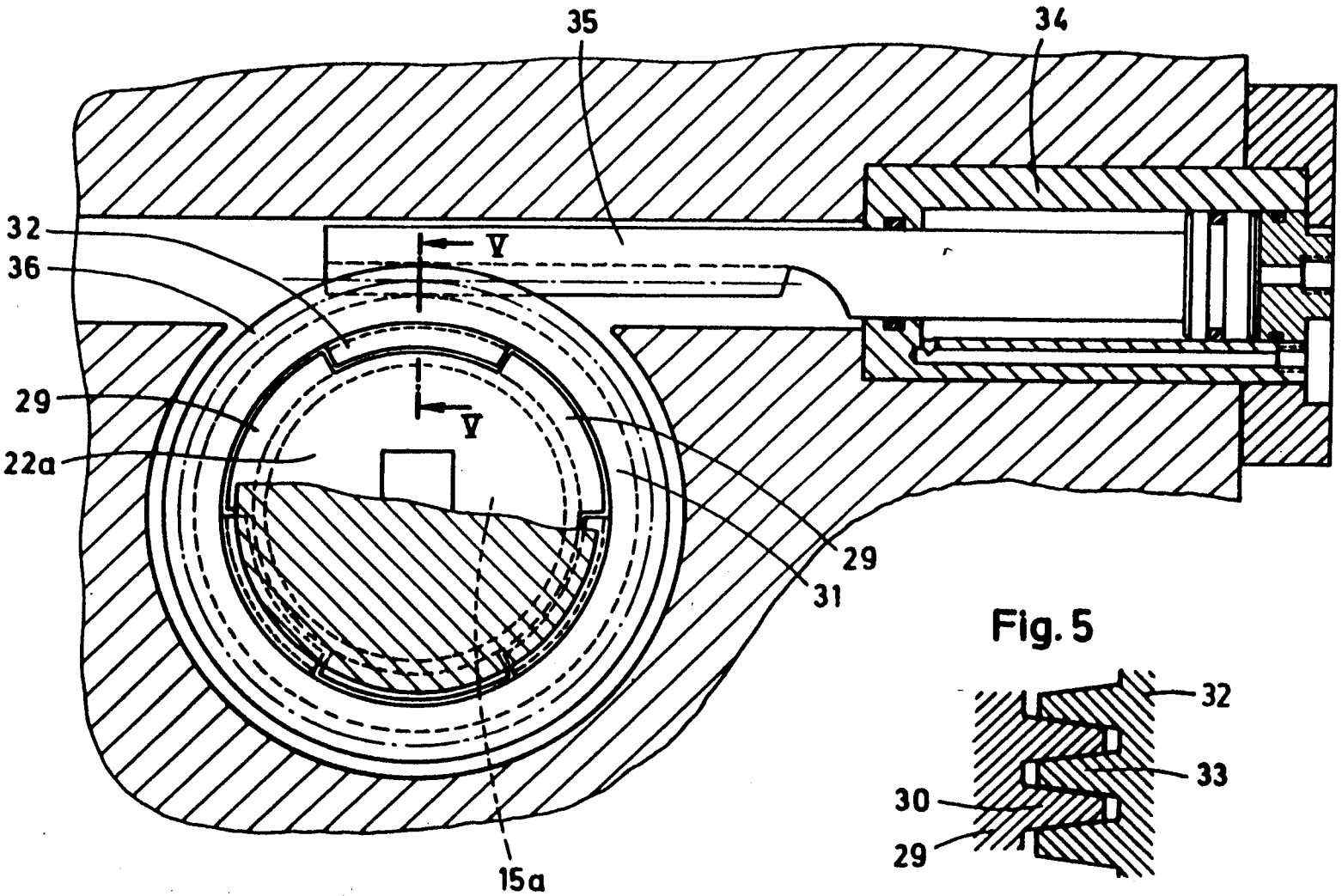

The balancing and bending apparatus for the work rolls of a four-high rolling mill according to this invention will be described below with reference to schematic drawings wherein:

FIG. 1 is a lateral view of a roll housing of a four-high rolling mill stand equipped with the balancing and bending apparatus, with a longitudinal sectional view of the apparatus in the nonoperating position, FIG. 2 shows an enlarged longitudinal sectional view of the lower and upper work roll chocks in the zone of an adjusting cylinder and, in each case, on an enlarged scale, FIG. 3 shows a section along line III—III of FIG. 2, FIG. 4 shows a section along line IV—IV of FIG. 2, and FIG. 5 shows a section along line V—V of FIG. 4 through the engaged coupling device.

The two roll housings 2 of the four-high rolling mill stand 1 according to FIG. 1 comprise windows 3 for accommodating a bottom 4 and top work roll chock 5 for supporting the lower 6 and the upper work roll 7, as well as for the accommodation of a lower 8 and of an upper backup roll chock 9 to support the lower 10 and the upper backup roll 11.

The four-high rolling mill stand 1 is equipped with an apparatus for counterbalancing and vertical bending of the two work rolls 6, 7, this apparatus operating with respectively two dual-acting hydraulic adjusting cylinders 13 installed in the bottom work roll chock 4 of the two roll housings 2 symmetrically to the roll axis plane 12—12. The adjusting cylinders 13 house an adjusting piston 14 for extending a piston rod 15, which is in the rest position 15', out of the bottom work roll chock 4 and for introducing the free end **15*a* of the piston rod 15 into the upper work roll chock 5 during rolling operation and for extending the piston rod 15 from the operative position 15'' into the rest position 15' into the bottom chock 4 for the separate dismounting of the work rolls 6, 7 in case a roll change is necessary. In the operating position 15'' of the piston rod 15, the free end 15*a* thereof is fixedly connected with the top chock 5 by means of a coupling device 16**.

The interior of the adjusting cylinders 13 is subdivided by the adjusting piston 14 into an upper **13*a* and a lower cylinder chamber 13*b*, and the upper cylinder chamber 13*a* is connected to a feed and discharge conduit 18 for hydraulic oil leading into the cylinder cover 17, and the lower cylinder chamber 13*b* is connected to a feed and discharge conduit 20 for hydraulic oil mounted to the cylinder bottom 19. The adjusting piston 14 is guided, secure against rotation, on a bolt 21 provided with two bevels and centrally seated in the cylinder bottom 19**.

In the operative position 15'', the piston rod 15 engages, with a conical centering pin **15*b* arranged centrally on its free end 15*a*, into a corresponding conical recess 22*b* in the lower end 22*a* of a shaft 22** articulated in the top chock 5 and secured against axial shifting when under tensile and compressive stress.

The inner shell 23*a* of the ball-and-socket joint 23 is attached by means of a nut 24 to the upper end 22*c* of the shaft 22 provided with a threaded pin 22*d*, and the outer shell 23*b* of the joint 23 is connected with a spacer sleeve 25 and a threaded insert member 26 in the upper work roll chock 5.

A leaf spring 28 is installed, as an elastic safety means for the shaft 22 against rotation of the latter, in a transverse groove 27 in the threaded pin 22*d* at the upper shaft end 22*c* and in corresponding grooves 25*a*, 25*b*, arranged in mutual opposition, in the spacer sleeve 25 serving for affixing the ball-and-socket joint 23. The groove 27 in the upper shaft end 22*c* is designed with a slight spherical bulge so that the leaf spring 28 can be somewhat adjusted and thereby an exact coupling engagement by the coupling device 16 is ensured (FIG. 3).

The coupling device 16, of the type of a bayonet catch, for connecting the piston rod 15 extended from the bottom chock 4 into the operating position 15" to the shaft 22 in the top chock 5 exhibits, on the free end 15*a* of the piston rod 15, annular segments 29 arranged with a specific pitch and having an outer thread 30. Furthermore, the coupling device 16 consists of a coupling sleeve 31 which latter is axially fixed, projects past the shaft end 22*a*, and is attached rotatably to the lower end 22*a* of the elastically rotationsafe shaft 22, this end lying in opposition to the free end 15*a* of the piston rod 15. The coupling sleeve carries on the inside annular segments 32 arranged at the same pitch as the annular segments 29 of the piston rod 15 with an internal thread 33 corresponding to the outer thread 30 of the annular segments 29. The coupling device furthermore comprises a rotary drive mechanism for the coupling sleeve 31 for the meshing and disengagement of the threads 30, 33 of the annular segments 29, 32 of the piston rod 15 and of the shaft 22 (FIGS. 4 and 5).

The rotary drive mechanism of the coupling sleeve 31 is fashioned as a rack-and-pinion drive unit exhibiting a rack 35 operated by a hydraulic cylinder 34 and being in engagement with a toothed rim 36 which latter is fixedly seated on the coupling sleeve 31; the coupling sleeve is rotatably mounted to the lower end 22*a* of the shaft 22 and is immovable in the axial direction (FIG. 4).

By rotation of the coupling sleeve 31 by means of the rack-and-pinion drive 34–36, the threads 30, 33 of the annular segments 29, 32 of the piston rod 15 and of the coupling sleeve 31 come into engagement so that the piston rod 15, arranged in the bottom work roll chock 4, and the shaft 22, supported in the top work roll chock 5, are tightened with respect to each other due to the pitch of the threads 30, 33, and thus a force-derived and shape-mating connection of the piston rod 15 and the shaft 22 is ensured for the transmission of tensile and compressive forces.

The engaged coupling device 16 for the firm connection of the piston rod 15, extended during rolling mill operation from the bottom chock 4 into the operating position 15", with the shaft 22 articulated in the top chock 5 is locked in place by the hydraulic cylinder 34. Upon introduction of hydraulic oil via the feed conduit 18 into the upper cylinder chamber 13*a* and exhausting of the lower cylinder chamber 13*b* by way of the discharge conduit 20, the two work roll chocks 4, 5 in the roll housings 2 are moved toward each other by the adjusting cylinders 13 in the bottom work roll chocks 4 of the two roll housings 2 of the four-high rolling mill stand 1. Accordingly, the work rolls 6, 7 are subject to concave deflection in the vertical direction with respect to the roll nip 37. Upon the introduction of hydraulic oil via the feed conduit 20 into the lower cylinder chamber 13*b* and relief of the upper cylinder chamber 13*a* via the discharge conduit 18, the two work roll chocks 4, 5 in the roll housings 2 are moved apart by the adjusting cylinders 13 so that a convex bending of the work rolls 6, 7 in the vertical direction with respect to the roll nip 37 is achieved. By the articulated support of the shafts 22 for transmitting the tensile and compressive forces exerted by the adjusting cylinders 13 on the upper chock 5, the relative motions between the bottom 4 and top chock 5 are compensated for during the vertical bending of the work rolls 6, 7 in such a way that the adjusting pistons 14 of the adjusting cylinders 13 in the bottom chock 4 and the associated shafts 22 in the top chock 5 during the bending of the rolls are always coaxially aligned, and the adjusting piston 14 in the adjusting cylinders 13 is not subject to any transverse forces, does not jam, and thereby runs without trouble.

We claim:

1. In an apparatus for counterbalancing and vertical bending of work rolls of a four-high rolling mill stand whose work rolls have axes lying in a common plane adjusting cylinders installed in upper and lower chocks in which said rolls are removably mounted, said chocks being arranged symmetrically to said plane, said cylinders being located symmetrically to said plane and having piston rods which project, during a rolling operation, from the lower work roll chock into the upper work roll chock, and means for releasably connecting the piston rods to the upper work roll chock; the improvement comprising, for each said piston rod, a shaft (22) having an upper end articulatedly connected to the upper chock and extending downwardly through the upper chock to a coupling device (16), and means on the coupling device and an upper end of said piston rod for releasably interconnecting said shaft and said piston rod, there being annular segments (29) with an outer thread (30) arranged on said upper end of each said piston rod, an axially fixed coupling sleeve (31) rotatably mounted on said lower end of said shaft (22), said sleeve projecting beyond said lower shaft end and comprising annular segments (32) with an internal thread (33) matching said outer thread (30), and a rotary drive mechanism in said upper chock for rotating said coupling sleeve (31).

2. Apparatus as claimed in claim 1, further comprising a rack-and-pinion drive mechanism for engaging and disengaging said coupling device and for locking said coupling device during a rolling operation, said rack-and-pinion drive mechanism comprising a rack (35) operated by a hydraulic cylinder (34), said rack meshing with a toothed rim (36) fixed on said coupling sleeve (31).

3. Apparatus as claimed in claim 1, further comprising a conical centering pin (15*b*) centrally disposed at said upper end of each said piston rod (15), said centering pin (15*b*) engaging in a conical recess (22*b*) in said lower end of said shaft (22).

4. Apparatus as claimed in claim 1, and elastic safety means releasably holding said shaft against rotation in said upper chock (5).

* * * * *